US005727275A

United States Patent [19]

Rocha

[11] Patent Number: 5,727,275

[45] Date of Patent: Mar. 17, 1998

[54] MANUAL CUP CLEANING SYSTEM

[76] Inventor: Manuel Antonio Rocha, 90 Cottonwood Rd., Hartford, Conn. 06111

[21] Appl. No.: 825,753

[22] Filed: Apr. 3, 1997

[51] Int. Cl.[6] ..... A47L 15/00; B08B 9/00

[52] U.S. Cl. ..... 15/104.92; 15/211; 15/164; 15/244.1; 15/114; 401/9; 401/24; 401/268

[58] Field of Search ..... 15/104.9, 211, 15/212, 213, 164, 165, 104.05, 244.1, 104.92, 114, 56, 65, 70, 71, 75; D32/40, 42; D4/137, 116; 401/268, 9, 24, 19, 283

[56] References Cited

U.S. PATENT DOCUMENTS

| | | | |
|---|---|---|---|
| 1,936,259 | 11/1933 | Parmes | 15/211 |
| 2,049,365 | 7/1936 | Follett | 15/164 |
| 2,128,011 | 8/1938 | Morgan | D4/116 |
| 2,263,356 | 11/1941 | Kapinos | 15/164 |
| 2,556,003 | 6/1951 | Sandell et al. | 15/211 |
| 2,768,402 | 10/1956 | Back | 15/164 |
| 3,086,241 | 4/1963 | Bohn | 15/211 |
| 3,135,003 | 6/1964 | Wise | 15/211 |
| 3,441,970 | 5/1969 | Krabal | 15/211 |
| 3,913,165 | 10/1975 | Behnk | 15/211 |

FOREIGN PATENT DOCUMENTS

| | | | |
|---|---|---|---|
| 1132766 | 11/1956 | France | 15/211 |
| 964770 | 5/1957 | Germany | 15/211 |

*Primary Examiner*—Gary K. Graham

[57] ABSTRACT

A manual cup cleaning system including a base member. The base member has a plurality of suction members coupled thereto for releasably mounting the base member onto a receiving surface. A conical member is provided. The conical member has a top surface, a support member, and an intermediate portion therebetween. The support member is sized for positioning within base member. Lastly, a plurality of bristles are attached to the conical member and project outwardly from the top surface. The bristles are capable of engaging an inside bottom of a cup that is positioned over the conical member for cleaning.

4 Claims, 3 Drawing Sheets

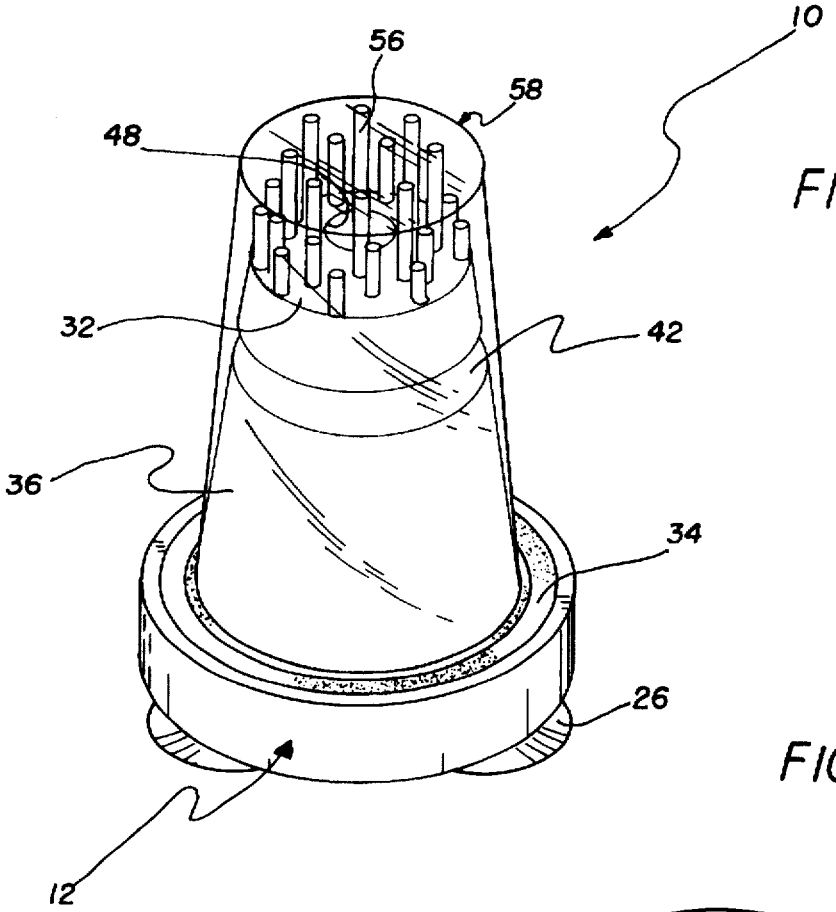
FIG.1
FIG.2
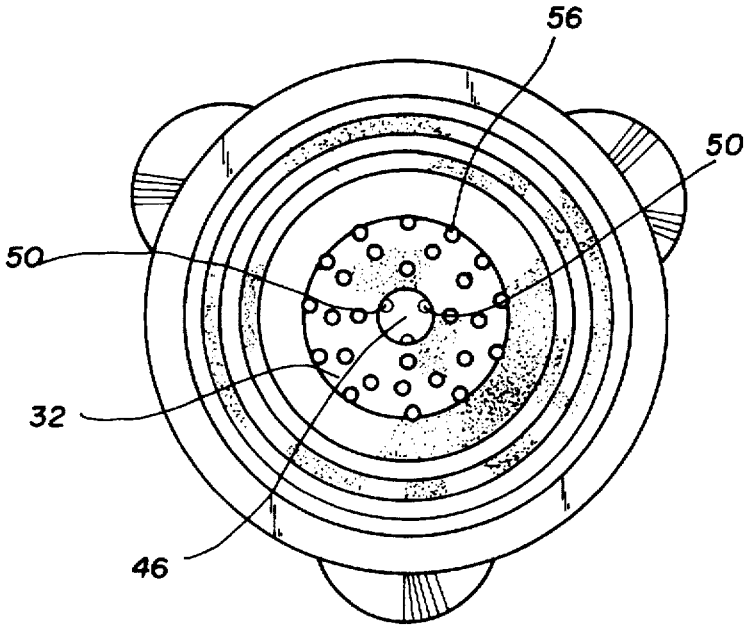

MANUAL CUP CLEANING SYSTEM

BACKGROUND OF THE INVENTION

1. Field of the Invention

The present invention relates to a manual cup cleaning system and more particularly pertains to providing a cleaning system for cups or glasses that conveniently attaches to the sink or dish pan and further attaching bristles as an additional utensil to assist with cleaning.

2. Description of the Prior Art

The use of a cup cleaning device is known in the prior art. More specifically, cup cleaning devices heretofore devised and utilized for the purpose of speeding up the cleaning process are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,315,729 to Yang discloses a cup washing machine. U.S. Pat. No.5,156,634 to Yang discloses a cup washing machine. U.S. Pat. No. 4,791,693 to Kvaternik discloses a corn silking apparatus. U.S. Pat. No. 4,317,249 to Benson discloses a device for cleaning containers. U.S. Pat. No. 4,223,418 to Pedrini discloses a device for quickly washing kitchenware, glasses, pots and the like. Lastly, U.S. Pat. No. 4,168,560 to Doyel discloses a battery-driven cleaning device.

In this respect, the manual cup cleaning system according to the present invention substantially departs from the conventional concepts and designs of the prior art, and in so doing provides an apparatus primarily developed for the purpose of providing a cleaning system for cups or glasses that conveniently attaches to the sink or dish pan and further attaching bristles as an additional utensil to assist with cleaning.

Therefore, it can be appreciated that there exists a continuing need for a new and improved manual cup cleaning system which can be used for providing a cleaning system for cups or glasses that conveniently attaches to the sink or dish pan and further attaching bristles as an additional utensil to assist with cleaning. In this regard, the present invention substantially fulfills this need.

SUMMARY OF THE INVENTION

In view of the foregoing disadvantages inherent in the known types of cup cleaning devices now present in the prior art, the present invention provides an improved manual cup cleaning system. As such, the general purpose of the present invention, which will be described subsequently in greater detail, is to provide a new and improved manual cup cleaning system which has all the advantages of the prior art and none of the disadvantages.

To attain this, the present invention essentially comprises a base member that has a base wall and a perimeter side wall projecting upwardly from an outer periphery of the base wall. The base wall has at least two drain holes. The base wall has a plurality of suction members coupled thereto for releasably mounting the base member onto a receiving surface. Included is a conical member that is formed of a flexible material. The conical member has a top surface, a support member, and an intermediate portion therebetween. The support member is sized for positioning between the perimeter side wall of the base member. The intermediate portion has a depression therearound and spaced from the top surface. A chamber is carved into the intermediate portion and defines an opening along the top surface of the conical member. The chamber has at least two channels extending therefrom and into the intermediate portion. Each channel is capable of passing through the intermediate portion and into the support member for allowing one of each channel to align with one of the drain holes of the base member. Lastly, a plurality of bristles are attached to the conical member. The bristles project outwardly from the top surface. The bristles are capable of engaging an inside bottom of a cup being positioned over the conical member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manual cup cleaning system which has all the advantages of the prior art cup cleaning devices and none of the disadvantages.

It is another object of the present invention to provide a new and improved manual cup cleaning system which may be easily and efficiently manufactured and marketed.

It is a further object of the present invention to provide a new and improved manual cup cleaning system which is of a durable and reliable construction.

An even further object of the present invention is to provide a new and improved manual cup cleaning system which is susceptible of a low cost of manufacture with regard to both materials and labor, and which accordingly is then susceptible of low prices of sale to the consuming public, thereby making such manual cup cleaning system economically available to the buying public.

Still yet another object of the present invention is to provide a new and improved manual cup cleaning system which provides in the apparatuses and methods of the prior art some of the advantages thereof, while simultaneously overcoming some of the disadvantages normally associated therewith.

Still another object of the present invention is to providing a cleaning system for cups or glasses that conveniently attaches to the sink or dish pan and further attaching bristles as an additional utensil to assist with cleaning.

Lastly, it is an object of the present invention to provide a new and improved manual cup cleaning system including a base member. The base member has a plurality of suction members coupled thereto for releasably mounting the base member onto a receiving surface. A conical member is provided. The conical member has a top surface, a support member, and an intermediate portion therebetween. The support member is sized for positioning within base member. Finally, a plurality of bristles are attached to the conical member and project outwardly from the top surface. The bristles are capable of engaging an inside bottom of a cup that is positioned over the conical member for cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the manual cup cleaning system constructed in accordance with the principles of the present invention.

FIG. 2 is a top plan view of the invention of FIG. 1

Similar reference characters refer to similar parts throughout the several views of the drawings.

DESCRIPTION OF THE PREFERRED EMBODIMENT

Figure 3:
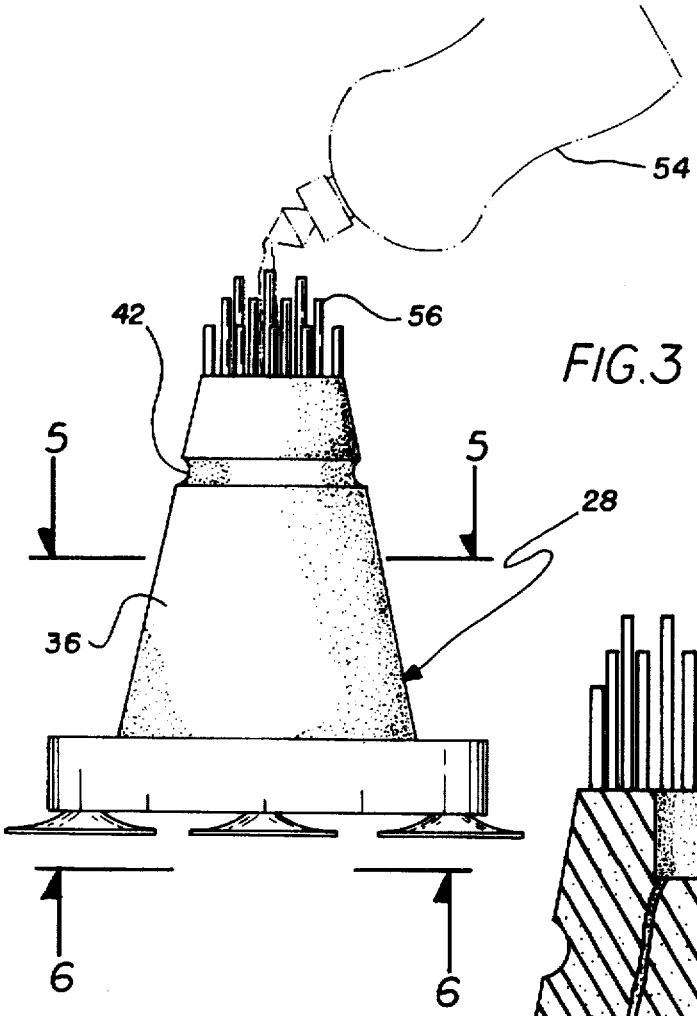
FIG. 3 is a side elevational view of the present invention in a pre-operable orientation.

With reference now to the drawings, and in particular to FIG. 1 thereof, a new and improved manual cup cleaning system embodying the principles and concepts of the present invention and generally designated by the reference numeral 10 will be described.

The present invention, the new and improved manual cup cleaning system, is comprised of a plurality of components. Such components in their broadest context include a base member and a conical member. Such components are individually configured and correlated with respect to each other so as to attain the desired objective.

Figure 4:
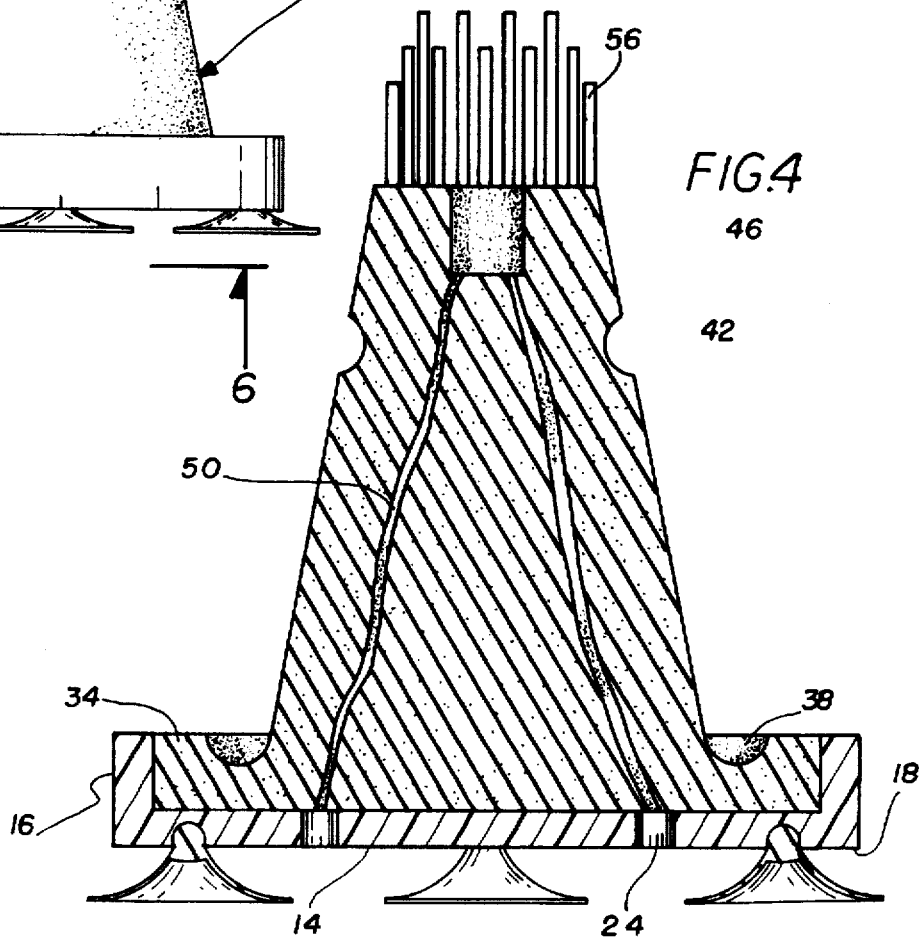
FIG. 4 is cross-sectional view of the present invention of FIG. 3.

More specifically, it will be noted that the present invention manual cup cleaning system has a base member 12. The base member has a base wall 14 and a perimeter side wall 16 projecting upwardly from an outer periphery 18 of the base wall. The base member of FIG. 1 is formed of plastic. The base wall has at least two drain holes 24, as shown in FIG. 4.

Figure 6:
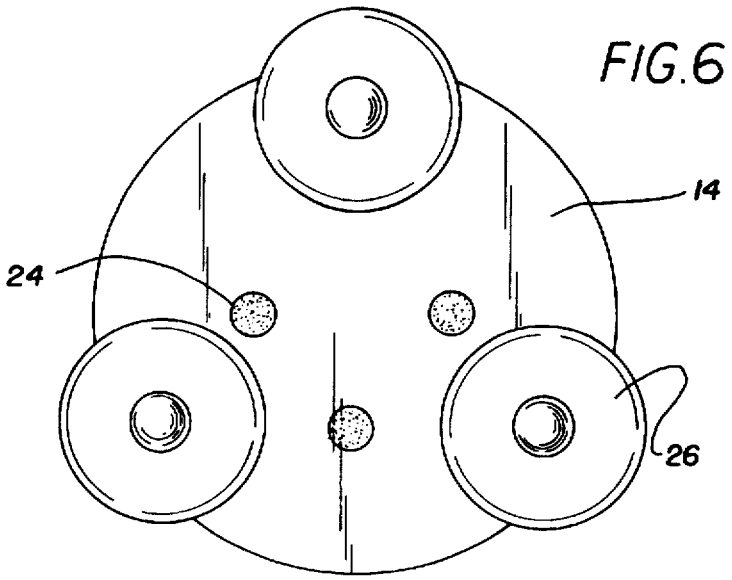
FIG. 6 is a bottom view of the present invention taken along line 6—6 of FIG. 3.

Preferably the base wall has three drain holes, as seen in FIG. 6. The base wall has a plurality of suction members 26 coupled thereto. The plurality of suction members allow for releasable mounting of the base member onto a receiving surface. Preferably the suction members are suction cups formed of rubber or similar material.

Figure 5:
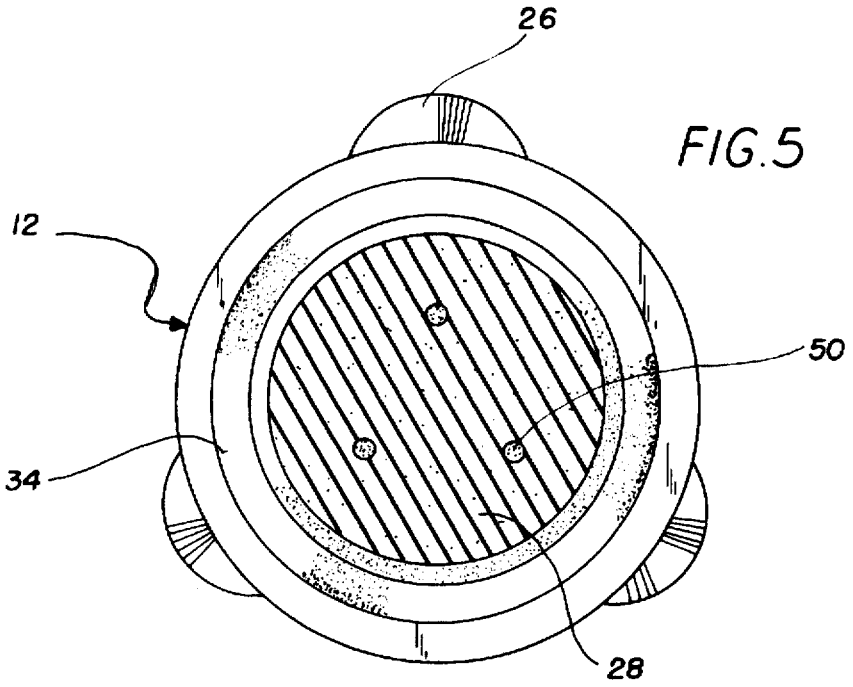
FIG. 5 is cross-sectional view of the present invention taken along line 5—5 of FIG. 3.

Also, a conical member 28 is provided. The conical member is formed of a flexible material, such as sponge. The conical member has a top surface 32, a support member 34, and an intermediate portion 36 therebetween. As shown in FIG. 5, the support member is sized for positioning between the perimeter side wall 16 of the base member 12. The support member has a trough 38, as shown in FIG. 4. The trough may be lined with small bristles. In FIG. 3, the intermediate portion is shown to have a depression 42 therearound and spaced from the top surface. The depression operates as a glass or cup lip wash ring.

Additionally, a chamber 46 is carved into the intermediate portion and defines an opening 48 along the top surface of the conical member. The chamber has at least two channels 52, with three channels being preferred. Each channel extends from the chamber and into the intermediate portion, as depicted in FIG. 4. Each channel passes through the intermediate portion and into the support member to allow one of each of the channels to align with one of the drain holes 24 of the base member. The chamber receives liquid soap 54 and the channels allow the soap to be disbursed into the conical member. Any excess soap trains from the conical member through the drain holes.

Lastly, a plurality of bristles 56 are attached to the conical member 28. As illustrated in FIG. 3, the bristles project outwardly from the top surface. The bristles are capable of engaging an inside bottom of a cup 58 that is positioned over the conical member for cleaning.

The present invention manual cup cleaning system for cleaning the interior of a cup or glass is easy to use. The glass is placed over the conical member, where the inside bottom of the glass is scrubbed with the bristles. The conical member is made of sponge of similar material, so as to absorb liquid soap and water. The base member has suction cups that allow releasable coupling of the base member to the sink or dish pan. Once the cup cleaning system is positioned on the receiving service, soap is put in the chamber. The conical member may be squeezed to allow the soap to travel down into a plurality of channels for disbursement into the conical member. With the conical member all soapy, the glass or cup is placed onto the conical member. The depression or trough may be used to clean the glass lip. The depth of the glass or cup determines which is used. The outside of the glass or cup may also be cleaned, simply rub it against the conical member and bristles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A manual cup cleaning system for cleaning an interior of a cup comprising in combination:

a base member having a base wall and a perimeter side wall projecting upwardly from an outer periphery of the base wall, the base wall having at least two drain holes, the base wall having a plurality of suction members coupled thereto for releasably mounting the base member onto a receiving surface;

a conical member being formed of a flexible material, the conical member having a top surface, a support member, and an intermediate portion therebetween, the support member being sized for positioning between the perimeter side wall of the base member, the intermediate portion having a depression therearound and spaced from the top surface, a chamber being carved into the intermediate portion and defining an opening along the top surface of the conical member, the chamber having at least two channels extending therefrom and into the intermediate portion, each channel capable of passing through the intermediate portion and into the support member for allowing one of each channel to align with one of the drain holes of the base member; and a plurality of bristles being attached to the conical member and projecting outwardly from the top surface, the bristles being capable of engaging an inside bottom of a cup being positioned over the conical member.

2. A manual cup cleaning system comprising:

a base member having a bare wall with a plurality of suction members coupled thereto for releasably mounting the base member onto a receiving surface, the base wall having at least two drain holes therethrough;

a conical member having a top surface, a support member, and an intermediate portion therebetween, the support member being sized for positioning within base member, said intermediate portion having a chamber carved therein and defining an opening along the top surface of the conical member, the chamber having at least two channels extending therefrom and into the intermediate portion, each channel passing through the intermediate portion and into the support member for allowing one of each channel to align with one of the drain holes of the base member; and a plurality of bristles being attached to the conical member and projecting outwardly from the top surface, the bristles being capable of engaging an inside bottom of a cup being positioned over the conical member for cleaning.

3. The manual cup cleaning system as set forth in claim 2, wherein the base member has a perimeter side wall projecting upwardly from an outer periphery of the base wall, and the support member being positioned within the perimeter side wall of the base member.

4. A manual cup cleaning system as set forth in claim 2, wherein the conical member being formed of a flexible material, and the intermediate portion having a depression therearound and spaced from the top surface.

* * * * *